United States Patent [19]

Chiba

[11] 4,163,439

[45] Aug. 7, 1979

[54] APPARATUS FOR OPENING A DELIVERY VALVE IN A GAS RESERVOIR CHAMBER OF A COMPRESSED GAS OPERATED GUN

[75] Inventor: Kensuke Chiba, Tokyo, Japan

[73] Assignee: Sharp Rifle Co., Ltd., Japan

[21] Appl. No.: 842,413

[22] Filed: Oct. 17, 1977

[30] Foreign Application Priority Data

Aug. 19, 1977 [JP] Japan ..... 52/98745

[51] Int. Cl.[2] ..... F41F 1/04; F41B 11/00

[52] U.S. Cl. ..... 124/70; 124/75

[58] Field of Search ..... 124/69, 70, 74, 75, 124/76, 31, 37, 38, 39, 35 R, 73

[56] References Cited

U.S. PATENT DOCUMENTS

| | | | |
|---|---|---|---|
| 1,292,665 | 1/1919 | Udesen | 124/73 |
| 2,638,884 | 5/1953 | Wells | 124/69 X |
| 3,308,803 | 3/1967 | Walther | 124/69 |
| 4,038,961 | 8/1977 | Olofsson | 124/69 |

FOREIGN PATENT DOCUMENTS

| | | | |
|---|---|---|---|
| 47-29278 | 8/1972 | Japan | 124/75 |

*Primary Examiner*—Richard T. Stouffer

*Attorney, Agent, or Firm*—Kane, Dalsimer, Kane, Sullivan & Kurucz

[57] ABSTRACT

An apparatus for opening a delivery valve in a gas reservoir chamber of a compressed gas operated gun comprises a compressed gas chamber in a cylinder and a gas reservoir chamber adjacent thereto. The gas reservoir chamber is normally closed at the side of the compressed gas chamber by a suction check valve and at the side opposite to the compressed gas chamber by a rod-like delivery valve which also closes a leading hole leading to a barrel bore. The delivery valve is slidably arranged within a through-hole which opens into the gas reservoir chamber at the side opposite to the suction check valve, and is urged by a spring so as to normally close the leading hole, and the rear end of the delivery valve is engaged by a latch lever of a trigger. Upon pulling the trigger to bring the latch lever of the trigger out of engagement with the delivery valve, the compressed gas within the gas reservoir chamber pushes backwards the delivery valve to open the leading hole, so that the compressed gas is introduced into the barrel bore through the leading hole to fire a projectile therein.

1 Claim, 1 Drawing Figure

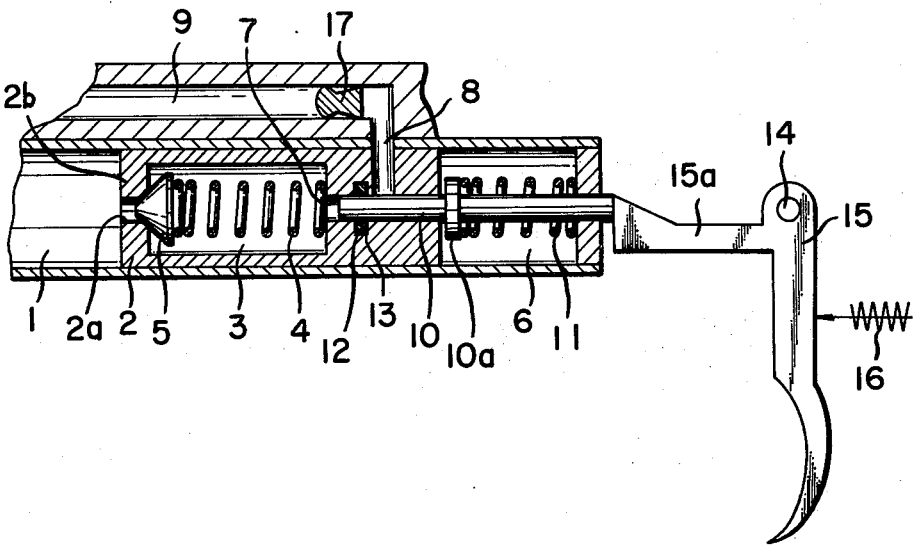
9
7
17
2b
8
14
15a
15
1
2a
2
5
3
4
12
13
10
10a
6
11
16

APPARATUS FOR OPENING A DELIVERY VALVE IN A GAS RESERVOIR CHAMBER OF A COMPRESSED GAS OPERATED GUN

BACKGROUND OF THE INVENTION

This invention relates to the improvement of an apparatus for opening a delivery valve in a gas reservoir chamber of a compressed gas operated gun.

This type of conventional apparatus was so constructed that a part of the delivery valve is struck by a striker to which momentum is imparted by the force of a spring, thereby causing the delivery valve to be opened. However, since an extremely strong force is required for imparting momentum to the striker, a shock at the time of collision of the striker with the delivery valve is considerably great and therefore causes vibration of the whole gun, which often resulted in missing the mark.

In order to improve such disadvantage, the same applicant as this application proposed a delivery valve opening apparatus in Japanese Pat. No. 678,511, which comprises a compressed gas chamber; a gas reservoir chamber adjacent thereto; a suction check valve arranged in a through-hole of a partition wall between the gas reservoir chamber and the compressed gas chamber; and a delivery valve means consisting of a delivery tube having a flange and slidable gas-tightly in a through-hole which opens into the gas reservoir chamber at the side opposite to the suction check valve, and a delivery valve body arranged coaxially adjacent to the rear end of the delivery tube and slidable in the through-hole; said delivery valve body being engaged at the rear end by one end of an intermediate lever biased by a spring so that an opening at the rear end of the delivery tube may be normally closed by the delivery valve body, and the other end of the intermediate lever being engaged by a lever of a trigger when compressed gas is supplied into the gas reservoir chamber from the compressed gas chamber. In operation of this apparatus, after supplying compressed gas from the compressed gas chamber into the gas reservoir chamber, pull of the trigger causes the delivery tube and the delivery valve body to be moved backwards together to a delivery opening by the compressed gas within the gas reservoir chamber, and then when the delivery tube is mechanically stopped by its flange, the delivery valve body is brought out of engagement with the delivery tube and further moved backwards, whereby the opening at the end of the delivery tube communicates with the delivery opening so that the compressed gas flows through the delivery opening into a barrel bore to thereby discharge a projectile such as pellet therein.

BRIEF SUMMARY OF THE INVENTION

It is an object of the invention to improve the apparatus in the above mentioned patent and to provide an apparatus for opening a delivery valve in a gas reservoir chamber of a compressed gas operated gun, which is simple in construction, smaller in number of parts and operates positively.

A further object of the invention is to provide a compressed gas operated gun which requires no operation for preparation of fire but to supply compressed gas into the gas reservoir chamber by a compressed gas pump and to charge the barrel bore with a projectile to be discharged.

According to one aspect of the present invention, there is provided an apparatus for opening a delivery valve in a gas reservoir chamber of a compressed gas operated gun, wherein the delivery valve means is constituted by a rod-like valve body, said valve body being slidably arranged within a through-hole of the valve housing which opens into the gas reservoir chamber at the side opposite to the suction check valve and being biased toward the gas reservoir chamber by a return spring to normally close the leading hole which leads to the barrel bore, and a sealing member is arranged in the valve housing so as to air-tightly engage the rod-like valve body when the leading hole is closed by the rod-like valve body, said rod-like valve body being engaged at its rear end by a latch lever of the trigger urged by a spring.

These and other objects and features of the invention will become more apparent upon a reading of the following detailed specification and drawing.

BRIEF DESCRIPTION OF THE DRAWING

The drawing is an axial sectional view of a delivery valve opening apparatus in a gas reservoir chamber of a compressed gas operated gun according to the invention and shows a state where the gas reservoir chamber is filled with compressed gas.

DETAILED DESCRIPTION OF THE PREFERRED EMBODIMENT

In the drawing, reference numeral 1 indicates a compressed gas chamber within a cylinder of a gas compressor, 2 a valve housing, and 3 a gas reservoir chamber. An opening **2*a* provided through a partition wall 2*b* between the compressed gas chamber 1 and the gas reservoir chamber 3 is normally closed by a suction check valve 5 biased by a spring 4. In the valve housing 2 at the side opposite to the suction check valve 5 there is provided a through-hole 7 which opens at one end into the gas reservoir chamber 3 and at the other end into a return spring cavity 6, and there is further provided a leading hole 8 which meets at right angles with the through-hole 7 at one end and leads to a barrel bore 9** at the other end.

According to the invention, a rod-like delivery valve 10 having a flange **10*a* is slidably fitted in the through-hole 7 and normally biased toward the gas reservoir chamber 3 so as to keep the leading hole 8 closed by a return spring 11 arranged within the return spring cavity 6. The forward end portion of the rod-like delivery valve 10 is gas-tightly sealed by a O-ring 13 which is interposed within a O-ring groove 12 immediately before the leading hole 8. When the gas reservoir chamber 3 is not filled with compressed gas, the flange 10*a* of the rod-like delivery valve 10 is in abutting engagement with the valve housing 2 by the force of the return spring 11, with the rear end of the rod-like delivery valve projecting somewhat from the end surface of the cylinder. A latch lever 15*a* of a trigger 15 pivotally mounted on a trigger shaft 14 is normally biased by a trigger spring 16 to directly engage with the rear end of the rod-like delivery valve 10. In the invention, the pivotal shaft 14 for the trigger is arranged on the axial line of the rod-like delivery valve 10, so that when compressed gas is supplied into the gas reservoir chamber 3 any torque due to the pressure acting on the delivery valve 10 is not produced in the trigger 15**.

In operation, compressed gas produced in the compressed gas chamber 1 within the cylinder of the gas compressor is forced into the gas reservoir chamber 3 against the spring 4 of the suction check valve 5. By repeating such pumping operation, compressed gas under high pressure is accumulated within the gas reservoir chamber 3. The compressed gas supplied in the gas reservoir chamber 3 is kept in air tight condition within the gas reservoir chamber 3 at one side by the suction check valve 5 and at the other side by the O-ring 13 and the rod-like delivery valve 10. At this time, the rear end of the rod-like delivery valve 10 is engaged by the latch lever 15*a* of the trigger 15. Then, the compressed gas operated gun is charged with a projectile such as pellet in the barrel bore 9 and the rear portion is closed. Upon pulling the trigger 15 to bring the rear end of the rod-like delivery valve 10 out of engagement with the latch lever 15*a* of the trigger, the compressed gas within the gas reservoir chamber 3 pushes backwards the forward end of the rod-like delivery valve 10 against the force of the return spring 11 so that the rod-like delivery valve 10 is moved backwards. When the forward end of the rod-like delivery valve 10 has passed the point where air-tight condition is kept by the O-ring 13, the gas reservoir chamber 3 communicates with the leading hole 8 through the through-hole 7, whereby the compressed gas within the gas reservoir chamber 3 forces and discharges the pellet 17 within the barrel bore 9. Thereafter when the pressure within the gas reservoir chamber 3 has dropped to a normal pressure, the rod-like delivery valve 10 is moved forwards by the return spring 11 to restore the original position and the gas reservoir chamber 3 is kept in air tight condition at the delivery side by the O-ring 13 and the delivery valve 10. Simultaneously, the latch lever 15*a* of the trigger 15 is returned to the initial position by the trigger spring 16 to thereby engage the rear end of the rod-like delivery valve 10.

Similarly to the afore-mentioned patent, as the conventional system of pressing open a delivery valve by the force of a powerful spring and a striker is not adopted in the apparatus according to the invention, it has the advantage that vibration and reaction of the gun at the time of firing are considerably reduced to thereby increase remarkably the number of hits, and that the operation for preparation of fire is simple, i.e. any operation for preparation of fire is not necessary with the exception of filling the gas reservoir chamber with compressed gas by a gas compressor and charging the barrel bore of the gun with a projectile to be discharged. Furthermore, as the delivery valve means is constituted by one rod-like delivery valve and the intermediate lever is not provided, the apparatus according to the invention provides the particular advantage that it is simple in construction, smaller in the number of parts and therefore facilitates the working and assembling, and operates positively.

While the described embodiment represents the preferred form of the present invention, it is to be understood that modifications will occur to those skilled in that art without departing from the spirit of the invention. The scope of the invention is therefore to be determined solely by the appended claims.

What is claimed is:

1. An apparatus for opening a delivery valve of a compressed gas operated gun comprising: a barrel having a bore therein adapted to receive a projectile; a cylinder secured to said barrel; a compressed gas chamber formed within said cylinder; a valve housing disposed within the cylinder adjacent the compressed gas chamber; a gas reservoir chamber disposed within said valve housing; a pair of through-holes extending into said reservoir chamber, one of said through-holes extending from said gas reservoir chamber into the compressed gas chamber and being normally closed by a check valve, the other of said through-holes disposed on the opposite side of said reservoir chamber from said one through-hole; a delivery valve slidably fitted within said other through-hole; a leading hole extending through the valve housing and connecting said other through-hole with the barrel bore, said leading hole being normally closed by said delivery valve; a return spring communicating with said delivery valve and biased to return the delivery valve to a position closing said leading hole; a sealing member disposed about said other through-hole and air tightly engaging said delivery valve to shut off communication between the gas reservoir and the leading hole; a shaft; a trigger pivotally mounted about said shaft, said trigger having a latch lever; a spring engaging said trigger and normally holding said latch lever in abutting engagement with said delivery valve, said latch lever being movable out of engagement with said delivery valve when said trigger is pulled, such that said delivery valve may be moved from its position closing the leading hole to compressed gas in the gas reservoir chamber, which compressed gas may then enter said bore through said leading hole, said delivery valve being normally engaged by and biased by said return spring; and, said shaft being disposed along the axial line of said delivery valve whereby when compressed gas is supplied into the gas reservoir chamber any torque due to the pressure force acting on the delivery valve is not produced in the trigger.

* * * * *